US006193445B1

(12) United States Patent
Scales

(10) Patent No.: US 6,193,445 B1
(45) Date of Patent: Feb. 27, 2001

(54) STABILIZATION OF EARTHEN SLOPES AND SUBGRADES WITH SMALL-APERTURE COATED TEXTILE MESHES

(76) Inventor: John M. Scales, 6347 Rosecommon Dr., Norcross, GA (US) 30092

( * ) Notice: Subject to any disclaimer, the term of this patent is extended or adjusted under 35 U.S.C. 154(b) by 0 days.

(21) Appl. No.: 09/253,208

(22) Filed: Feb. 19, 1999

(51) Int. Cl.[7] ..... E02D 29/02
(52) U.S. Cl. ..... 405/284; 405/262
(58) Field of Search ..... 405/258, 262, 405/284, 263, 15, 128, 129

(56) References Cited

U.S. PATENT DOCUMENTS

| | | |
|---|---|---|
| 3,142,109 | 7/1964 | Stoll et al. . |
| 3,421,326 | 1/1969 | Vidal . |
| 4,421,439 | 12/1983 | ter Burg et al. . |
| 4,804,299 | 2/1989 | Forte et al. . |
| 4,914,876 | 4/1990 | Forsberg . |
| 5,087,150 | 2/1992 | McCreary . |
| 5,091,247 | 2/1992 | Willibey et al. . |
| 5,096,335 | 3/1992 | Anderson et al. . |
| 5,187,005 | 2/1993 | Stahle et al. . |
| 5,199,825 | 4/1993 | Travis . |
| 5,277,520 | 1/1994 | Travis . |
| 5,320,455 | 6/1994 | Mattox . |
| 5,417,253 | 5/1995 | Scales . |
| 5,599,139 | 2/1997 | Chewning et al. . |
| 5,616,399 | 4/1997 | Theisen . |
| 5,669,796 | 9/1997 | Harford . |
| 5,713,392 | 2/1998 | O'Rourke . |
| 5,736,466 | 4/1998 | Wierer et al. . |
| 5,800,095 | 9/1998 | Egan . |

OTHER PUBLICATIONS

Designing with Geosynthetics, Koerner, Robert M., Prentire–Hall, Inc., Englewood Cliffs, NJ 07632, 3rd —p. 37–39; 328–351.

Designing with Geosynthetics Chapter 2, pp. 40–42.

Designing with Georsynthetics Chapter 3, pp. 192–199.

Safe Slope Reinforcement and Stable embankment construction.

*Primary Examiner*—Frank Tsay
(74) *Attorney, Agent, or Firm*—Baker, Donelson, Bearman & Caldwell

(57) ABSTRACT

A textile mesh for stabilizing earthen slopes and subgrades formed of interwoven, knitted, or stitch-bonded weft and warp elements that define a plurality of stable apertures of substantially uniform size by respective portions of the elements which have respective lengths of less than 12 millimeters. The textile mesh is coated with a curable material for interlocking the elements at junctions, whereby the textile mesh is rigidly flexible for facilitating handling during construction of a soil-stabilized earthen slope yet the junctions are substantially rigidly interlocked in order for the apertures to remain of substantially uniform size. The textile mesh is enclosed by layers of a backfill comprising particles of a size having an average diameter that is less than or equal to about 30% of the smaller of the lengths of the portions defining the apertures and at least 50% of which pass a number 4 sieve (4.75 mm). The particles strike-through the apertures to mechanically engage the textile mesh and the backfill for stabilizing soil in earthen slopes and subgrades.

27 Claims, 4 Drawing Sheets

STABILIZATION OF EARTHEN SLOPES AND SUBGRADES WITH SMALL-APERTURE COATED TEXTILE MESHES

TECHNICAL FIELD

The present invention relates to structures for stabilization of earthen slopes and subgrades. More particularly, the present invention relates to structures constructed with coated textile meshes that have flexible rigidity and rigid, interlocked junctions of yarn elements that define substantially uniform small apertures that receive backfill particles for mechanically engaging the backfill for stabilization of earthen slopes and subgrades.

BACKGROUND OF THE INVENTION

Steep slopes, embankments and subgrades of earth often require stabilization to prevent catastrophic soil movement. Generally, soil stabilization is required in construction involving roadways, foundations, retaining walls, and the like, in which slopes, embankments, and subgrades of soil are susceptible to soil movement. While stabilization can be accomplished by using high quality, select soils in the slopes or subgrades, it is often desired to reuse existing soil at construction sites. In such cases, and sometimes even with use of supplemental select soils, acceptable safety factors require the construction of additional structures to effect stabilization of the soil in the earthen structure. Some soil stabilization applications use underlayments or layers of sheet materials which are covered with backfill materials, while other applications incorporate retaining walls from which sheet materials extend and are covered with backfill materials. The retaining walls typically are constructed of a plurality of blocks which connect together. Some known blocks have bores which receive pins or dowels to connect blocks in vertically adjacent tiers. Other types of blocks have opposing top and bottom surfaces which are often configured for interlocking engagement, in order for the wall made of the blocks to be mechanically connected together.

These retaining walls also generally include at least one laterally extending horizontal reinforcing sheet that prevents sliding or rotational failure of the slope. In a typical site construction, the retaining wall includes many vertically-spaced sheets. A side portion of the sheet attaches to the wall, such as by being held between adjacent tiers of blocks or by connectors disposed in the wall.

Generally, the sheets are substantially flat sheets which define a plurality of large openings or apertures. During construction of the wall, backfill covers the sheet. Rocks and stone, generally known as gravel, and soil in the backfill occupy apertures in the sheets. Gravel generally is a material of which 50% or more is retained on a number 4 sieve (4.75 mm openings). The occupancy of the apertures by backfill is known in the industry as "strike-through." The apertures permit strike-through of backfill materials from one side of the sheet to the other, which is a desirable feature for soil stabilization. The strike-through materials mechanically connect the sheet to the backfill, and thereby secure the retaining wall to the backfill. Such sheets and backfill are also used in underlayments for roadways and foundations or in layers for reinforcement of steep embankments and slopes.

The anchorage or pullout resistance of a sheet in backfill is the result of the following separate mechanisms. One mechanism is the shear strength along the top and bottom of the load-bearing elements of the sheet. A second of the shear strength mechanisms is the contribution along the top and bottom elements of the sheet transverse to the load-bearing elements. For those sheets where strike-through occurs, a third mechanism provides passive resistance of the backfill against the front of the transverse elements. The front portions of the striking material makes contact with the front face of the transverse elements. The resistance loading is transferred to the intersection or junction of the longitudinal and transverse elements. The intersection transfers the load to the load-bearing elements.

Several types of sheets have been used for stabilizing earthen slopes and subgrades. The sheets are generally woven, knitted, or stitch-bonded textiles or extruded, oriented plastic sheets.

Woven, knitted, or stitch-bonded textiles have longitudinal yarns (warp yarns), interwoven, knitted, or stitch-bonded with transverse yarns (weft yarns). These textiles are characterized as having poorly defined and dimensionally unstable intersections or junctions between the warp and weft yarns. The large surface area of textile sheets generally is substantially closed, and this prevents passage of the soil backfill through the sheet during installation and compaction of backfill. Without significant amounts of soil striking through open portions of the sheet, the sheet has reduced anchorage strength or reduced resistance to pullout. Woven, knitted, or stitch-bonded textiles exhibit generally poor abrasion resistance and are easily damaged during installation. When such textiles are placed under a load, the yarns transverse to the loading tend to slide relative to the yarns parallel to the loading. The intersection defined by the warp and weft yarns become distorted. The shifting of the yarns and induced soil movement reduces the shear orientation of the soil. This reduces the shear strength contribution along the top and bottom of the sheet. Further, because the aforementioned textiles are substantially or entirely closed, there is little, if any, contribution of the passive resistance mechanism discussed above, to the anchorage or pullout resistance of this sheet.

Increased junction strength at the intersection of the warp and weft yarns overcomes the tendency of the yarns to slide or shift. This may be accomplished by coating the sheets to provide a stronger junction between the warp and weft yarns at the intersections and also to an extent by the particular weave pattern. However, when a woven, knitted, or stitch-bonded textile without well defined openings is coated, it generally becomes impermeable. An impermeable textile will result in significantly reduced drainage of surface and ground water vertically through the reinforced soil structure. Without drainage, destabilizing hydrostatic pressures will develop within the soil structure.

Another type of sheet for stabilizing earthen slopes and subgrades is extruded geogrid sheet formed with flexible, high strength oriented polymer plastics. The sheets are generally substantially flat sheets with relative large openings of 12 mm or larger. The openings, generally known in the industry as "apertures," are defined by longitudinal ribs and transverse bars. The sheets typically have relatively even ratios of open apertures and closed space defined by the ribs and bars. The backfill of gravel and soil readily strikes through the apertures and the gravel in the backfill forms mechanical linkages between the backfill and the geogrid.

While extruded geogrids have been gainfully employed, there are drawbacks which limit their use in certain applications. Geogrid installations are significantly more expensive in materials and labor to install. Generally, the polymeric extruded/oriented geogrids are most effective when using gravel as a backfill. Often, however, the backfill for a site is comprised primarily of earthen soil materials removed from an excavation, with supplemental fill dirt. These materials, however, being substantially smaller than the apertures in the geogrid, fail to satisfactorily mechanically engage with the geogrid.

Additionally, extruded geogrids have thick transverse bars and thin longitudinal ribs. The thin ribs are oriented. The transverse bars and the junction between the longitudinal ribs and the transverse bars are not oriented. Therefore they have lower tensile strength and modulus. This gives inconsistent tensile and elongation properties when the longitudinal ribs are placed under load. The extruded geogrids are also heavy and awkward to maneuver, and often, mechanical devices are required to hold the geogrid during installation. For example, extruded geogrids tend to have high memory. The geogrid typically is supplied in rolls, and the geogrid tends to re-roll during installation. The geogrid accordingly requires firm holding during installation.

Another type of large aperture geogrid has addressed these problems. This type is a coated textile made of woven, knitted or stitch-bonded yarns. The textile is coated with a curable material to form stronger junction intersections than is provided by noncoated textiles. These types of geogrids define apertures of relatively large sizes having dimensions of 12 mm (½ inch) or larger, designed to replicate the typical dimensions of extruded, oriented polymer plastic geogrids. These are generally lighter-weight than extruded, oriented polymer geogrids, which facilitates handling and installation. The relatively large surface area of this type of textile sheet provides reasonably high shear stress when subjected to normal stress. However, coated large aperture geogrids do not have the junction strength of extruded, oriented polymer plastic geogrids. Due to the long distance between transverse elements and the resulting high load applied by the passive resistance of the strike-through materials on the transverse elements, the coating is often not strong enough to maintain secure junctions. In addition, the long distance between junction joints and the very high flexibility of the yarns comprising the longitudinal and transverse elements contributes to significant deformations of the transverse elements and junctions under load and results in potential movement of the geogrid in the direction of the applied load within the soil structure.

The large apertures in such geogrids provide linkage between the geogrid and the gravel and/or course grained soil in the backfill. However, many constructions, such as steep slopes, retaining walls, and embankments over soft subgrades, use backfill that is typically only or primarily soils of small particle size. "Small particles" in soil are those in which more than 50% pass a number 4 sieve. Such small soil particles insufficiently mechanically transmit bearing loads against the large widely spaced transverse elements that define the large apertures in geogrids previously used. Large aperture grids, while used in such applications, are most efficient when less than 50% of the soil particles pass a number 4 sieve.

Accordingly, there is a need in the art for small-aperture coated textile sheets to mechanically stabilize slopes, embankments, subgrades, foundations, and retaining walls with backfill materials of primarily soils of small particles. It is to such that the present invention is directed.

SUMMARY OF THE INVENTION

The present invention meets the need in the art by providing small-aperture coated textile meshes or sheets for soil stabilization of earthen slopes, embankments, subgrades, foundations, and retaining walls, with soils of small particles. The small-aperture coated textile mesh comprises a plurality of interwoven, knitted, or stitch-bonded longitudinal and transverse elements that define a plurality of apertures. All longitudinal elements are of substantially equal first strength and all transverse elements are of substantially equal second strength. This give the mesh consistent elongation and tensile properties across the mesh in their respective directions without areas of lower tensile strength and high elongation, particularly at the longitudinal and transverse junctions. The apertures are each of a substantially uniform size as defined by respective portions of the warp and weft elements. Each of the portions have respective lengths that are less than 12 millimeters. The textile mesh is coated with a curable material for rigidly interlocking the longitudinal and transverse elements together at junctions. The well defined apertures provided in the mesh facilitate permeability of water vertically through the mesh. The small-aperture coated textile mesh has flexural rigidity for facilitating handling during construction, yet the junctions are substantially rigid in order for the apertures to remain of substantially uniform size during use of the textile mesh for connecting to the backfill. The backfill comprises particles of sizes for which the average particle diameter is less than or equal to about 30% of the lesser of the lengths of the portions of the elements defining the apertures and at least 50% of the particles pass a number 4 sieve of about 4.75 mm. A portion of the particles in the backfill strike-through the apertures in the textile mesh and mechanically engage the transverse elements that define the apertures for anchoring the textile mesh to the backfill.

Objects, advantages and features of the present invention will become further apparent from a reading of the following detailed description of the invention and claims in view of the appended drawings.

DETAILED DESCRIPTION OF THE PREFERRED EMBODIMENT

Figure 1:
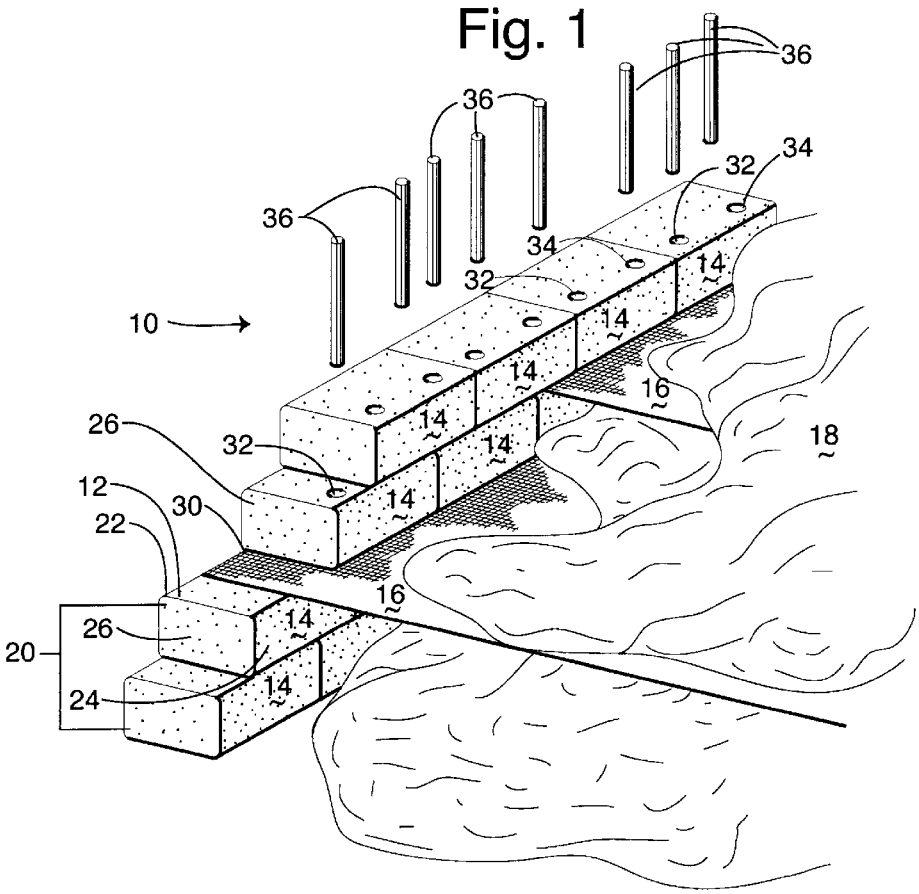
FIG. 1 is a perspective rear view of a retaining wall with small-aperture coated textile meshes extending laterally thereof for connecting the retaining wall to soil particles of backfill, according to the present invention.
Figure 2:
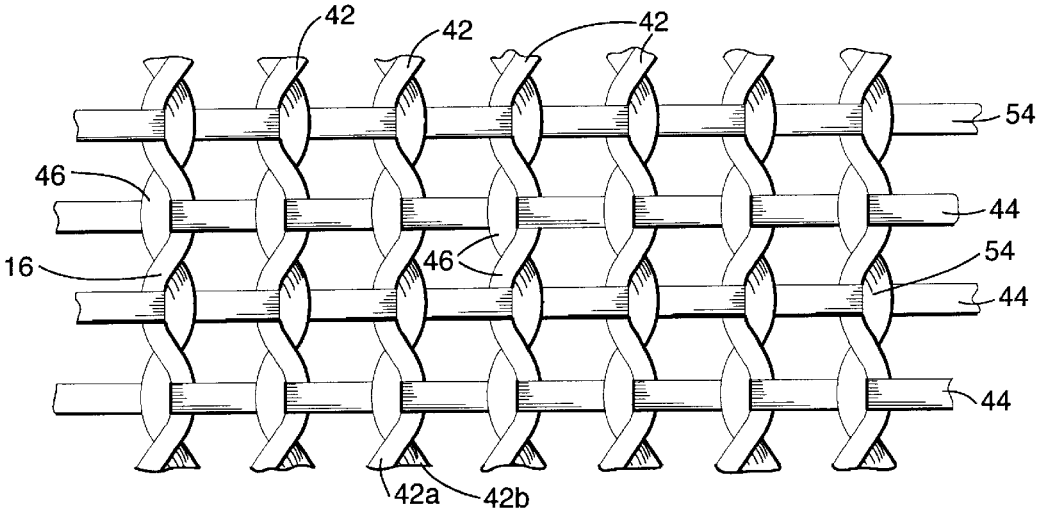
FIG. 2 is an enlarged detailed plan view of a portion of a small-aperture coated textile mesh, as illustrated in FIG. 1.

Referring now in more detail to the drawings in which like parts have like identifiers, FIG. 1 illustrates in perspective rear view a retaining wall 10 having a small-aperture coated textile mesh 16 or sheet extending into backfill 18 for soil stabilization according to the present invention. FIG. 2 is an enlarged detailed plan view of a portion of one of the coated small-aperture textile meshes 16. The textile mesh 16 comprises a plurality of yarns 41 (best illustrated in greatly enlarged view in FIG. 3) that are interwoven, knitted, or stitch-bonded conventionally to form longitudinal, or warp, elements or yarns 42 and transverse, or weft, elements or yarns 44. In the illustrated embodiment showing a full leno weave, the warp elements each comprise a pair of yarns 42*a*, 42*b*. In uniaxial textile meshes, the longitudinal elements are the high strength, load-bearing elements. In biaxial textile meshes, the longitudinal and transverse elements are substantially equal in strength. In the illustrated embodiment, the warp elements 42 and the weft elements 44 interweave at junctions 46; however, the textile mesh 16 can be constructed by any suitable intermeshing operation such as regular or leno weaving, knitting, stitch-bonding, or the like. In a preferred embodiment, the mesh 16 comprises full leno weaving of the longitudinal and transverse elements. Accordingly, the textile mesh 16 provides a sheet of interlinked warp and weft yarns, or elements, in which the tensile strength and the modulus of the longitudinal and transverse elements that bear the loading are consistent throughout the textile mesh and through the junction.

The textile mesh 16 defines a plurality of small-size open apertures or apertures 48. Each open aperture 48 is substantially uniform in size. The apertures 48 are defined by respective first and second portions 50, 52 of the warp and weft elements 42, 44, respectively. The portions 50, 52 each have respective lengths which are less than 12 millimeters. It is to be appreciated that the first and second portions are preferably substantially equal, although the length of one of first or second portions 50, 52 may exceed the other of the portions 52, 50. In one embodiment, the apertures 48 are approximately 2.5 mm×2.5 mm (1/10th inch by 1/10th inch). The number of transverse elements per unit length of the textile mesh 16 is preferably the maximum possible yet not spaced closer than the longitudinal elements or wider than about 12 mm. This reduces the deformation which is experienced by large aperture coated grids and reduces the load per junction.

The longitudinal elements provide strength, but the junction strength between the longitudinal and transverse elements is also important. Soil particles 60 strike-through the apertures 48 of the textile mesh 16 and bear against the transverse elements, which transmits their loads to the longitudinal elements through the junction. If the junctions are inadequate, the junctions will fail at a low tensile stress, and it will be reflected by a low anchorage strength to the backfill 18.

The textile mesh 16 includes a curable coating 54 that secures the warp and weft elements 42, 44 together at the junctions 46, in order to maintain the substantially uniform sized apertures 48 during use of the textile mesh 16. The curable material that coats the textile mesh 16 comprises a durable solidified binder. In a preferred embodiment, the curable coating is latex or PVC-based plastic materials. The resulting textile mesh 16 of yarns is substantially open, permeable, and is rigidly flexible which facilitates handling during construction of the retaining wall, yet the intersections are substantially rigid and interlocked so that the apertures 48 remain of the substantially uniform size.

Figure 3:
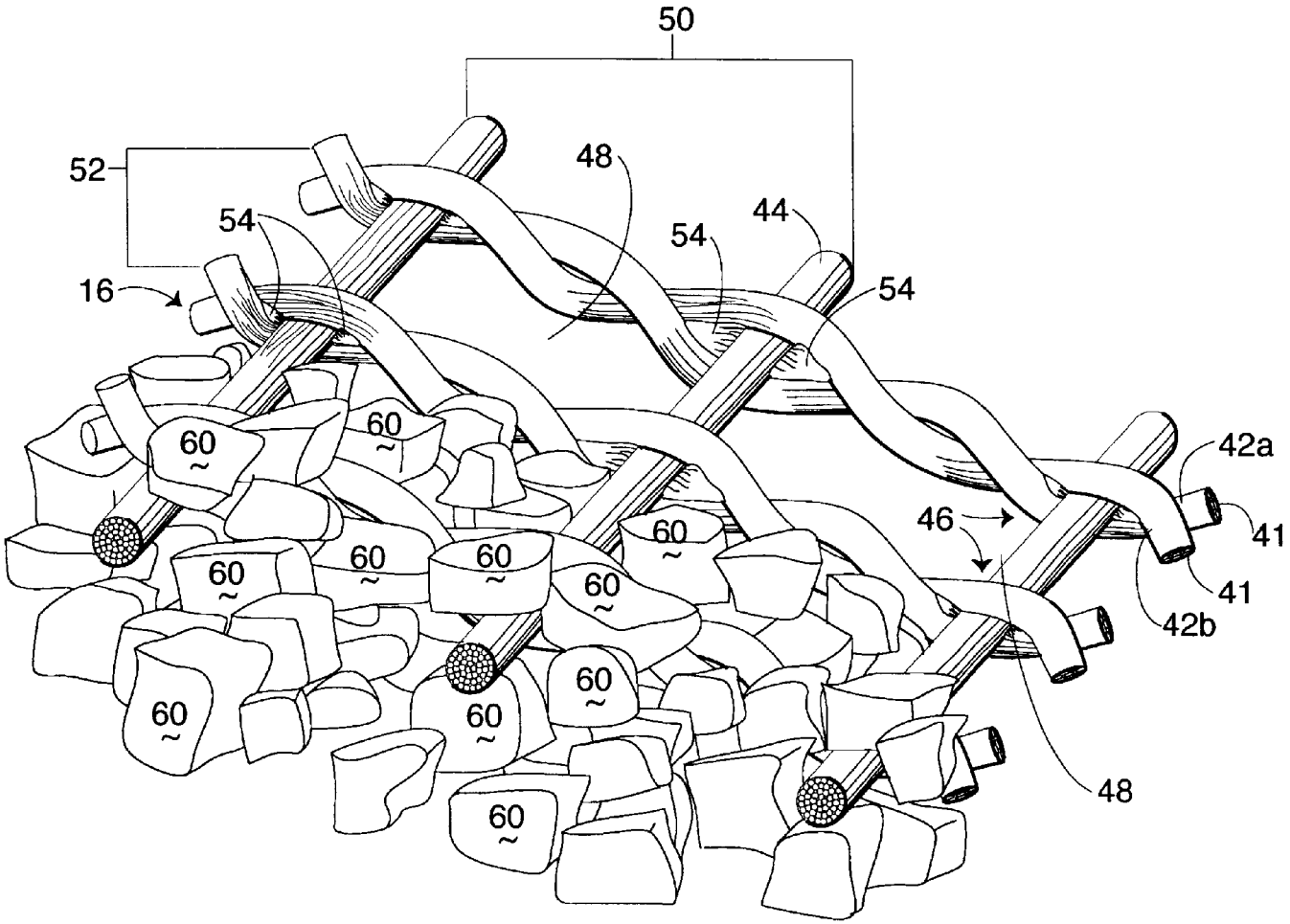
FIG. 3 is an enlarged perspective view of a portion of the small-aperture coated textile mesh with particles of soil backfill, as illustrated in FIG. 1.

FIG. 3 is an enlarged perspective view of a portion of the coated small-aperture textile mesh 16 with a plurality of particles 60 of backfill 18, as illustrated in FIG. 1. The backfill 18 substantially comprises soil particles of sizes substantially less in greatest length than the first and second lengths 50, 52. Preferably, the backfill 18 comprises soil particles of sizes having an average diameter that is less than or equal to about 30% of the lesser of the lengths of the portions 50, 52 of the warp and weft elements 42, 44 that define the apertures 48. Further, at least 50% of the particles 60 pass a number 4 sieve of 4.75 mm. The soil particles 60, and the relative size of the particles in the backfill 18, enable the backfill to mechanically connect with the textile mesh 16, for a purpose discussed below. It is contemplated that gainful use of the present invention will be accomplished also with cohesive soils comprised primarily of small particles, organic matter, and water, which clump together into balls, in that the cohesive soils would strike through the apertures upon compaction during installation.

The small-aperture coated textile mesh 16 of the present invention provides a reinforced composite useful for stabilizing soil structures such as earthen slopes, embankments, subgrades, foundations, and retaining walls. With continued reference to FIG. 1, a plurality of the textile meshes 16 are used with the retaining wall 10 that comprises a segmented wall 12 of blocks 14 from which the coated small-aperture woven textile meshes 16 extend laterally for connecting the wall of blocks to the backfill 18. The backfill 18 comprises soil particles, preferably of an earthen soil material as discussed below.

The wall 12 comprises at least two vertically-spaced tiers 20 of blocks 14 placed side-by-side. The blocks 14 are preferably cast cementatious blocks. Each block 14 has opposing exterior and interior surfaces 22, 24, opposing sides 26, and opposing upper and lower surfaces 28, 30. The exterior surface 22 can include ornamental designs, as is conventional for such cast blocks.

In the illustrated embodiment, the blocks 14 define channels 32, 34 through the blocks which open to the upper and lower surfaces. Dowels or pins 36 extend through the channels of the vertically spaced tiers for facilitating the strength of the wall 12.

The retaining wall 10 of the present invention is constructed as discussed below with reference to FIG. 1. A site for the wall 10 is selected, and if desired, a trench can be cut for receiving a tier of foundation base blocks placed side-by-side. A plurality of the blocks 14 are then placed side-by-side in tiers to form the segmented wall 12. The blocks 14 are preferably offset so that the sides of the blocks in one tier are staggered with respect to the sides of the blocks in the adjacent tiers. Backfill material 18 is placed behind the retaining wall and against the interior face of the wall. At a selected height of the wall 12, one of the coated small-aperture textile meshes 16 is pulled over the backfill and over the upper surface of the blocks 14 in the particular tier of the wall 10. The rigidly flexible textile mesh 16 is readily handled for installation. An edge portion of the textile mesh 16 is laid on the upper surface of the blocks 14 in the selected tier. Additional blocks 14 are then placed on the selected tier of blocks to entrap the edge portion of the textile mesh 16 between the mating upper and lower surfaces of the blocks 14 in the vertically adjacent tiers. Blocks 14 in vertically adjacent tiers are connected together with dowels 36, which pass through aligned openings in the blocks 14. The backfill material 18 is placed over the textile mesh 16, which material strikes through the open apertures 48 of the textile mesh. The backfill material 18 is preferably compacted.

The process of building the retaining wall 10 is continued. Additional blocks 14 are stacked side-by-side in higher tiers. In the illustrated embodiment, adjacent tiers of blocks 14 are joined by inserting the dowels 36 through the aligned bores of the vertically spaced blocks. Additional backfill material 18 is placed over the textile mesh 16 and compacted. Additional textile meshes 16 are placed at selected tiers, with edge portions of the textile meshes entrapped between blocks 14 of vertically adjacent tiers. The backfill material 16 strikes-through the textile meshes 16, and is preferably compacted. At the selected height of the wall 10, the final tier of blocks is placed on the wall. Additional backfill material 18 is placed over the textile mesh 16 behind the wall, and can be compacted to set the backfill material in engagement with the textile meshes 16.

During use of the retaining wall 10, the segmented wall 12 and the textile mesh 16 experience loading imposed by the backfill 18. As illustrated in FIG. 3, the particles 60 strike-through the apertures 48 as well as being both above and below the substantially horizontally disposed textile meshes 16. The textile meshes 16 have a reduced tendency to move, shift, or slide under loading due to the strike-through mechanical linkage between the particles 60 and the elements defining the apertures 48 and also due to the shear strength contribution along the top and the bottom of the warp and weft elements. With the junctions of the elements secured together, the apertures 48 remain fixed, which holds the particles 60 in place. The loading accordingly is distributed across the textile mesh 16, rather than concentrated in a localized portion. This results in improved stability for the textile meshes 16. Anchorage of soils is thereby distributed over a greater area of control by the textile meshes and that results in the retaining wall having increased strength.

Figure 4:
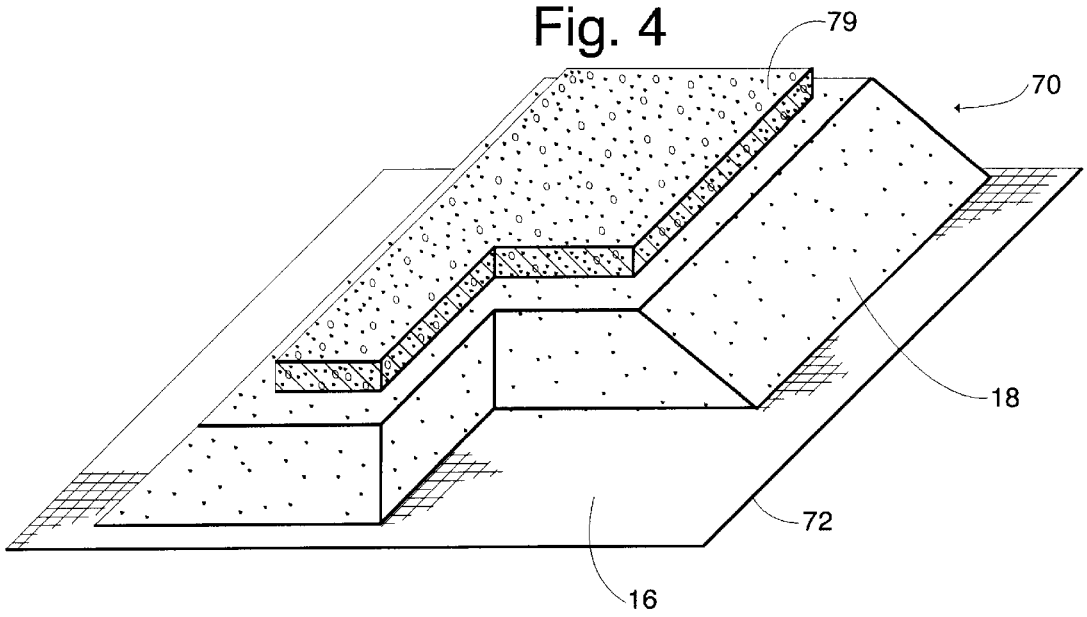
FIG. 4 is a perspective cut-away view of the small-aperture coated textile mesh of the present invention used for soil stabilization of a subgrade of an embankment soil structure, foundation or roadway.

While the present invention has been disclosed in terms of a retaining wall for slope soil stabilization, the present invention likewise is useful in soil stabilization of embankments, steep slopes, foundations, and subgrades of earth, such as for roadways and the like. FIG. 4 illustrates in cross-sectional perspective view an embankment 70 in which the textile mesh 16 defines a horizontal layer 72 within the slope of backfill 18 to be stabilized. The textile mesh 16 is enclosed by layers of backfill 18 above and below the textile mesh, with the backfill interlocking with the textile mesh by striking through the apertures 48. The textile mesh 16 is first laid over the subgrade and covered with backfill 18 that is compacted to strike through the apertures 48 in the mesh. In the illustrated application, a roadway 79 is installed on an upper surface of the embankment.

Figure 5:
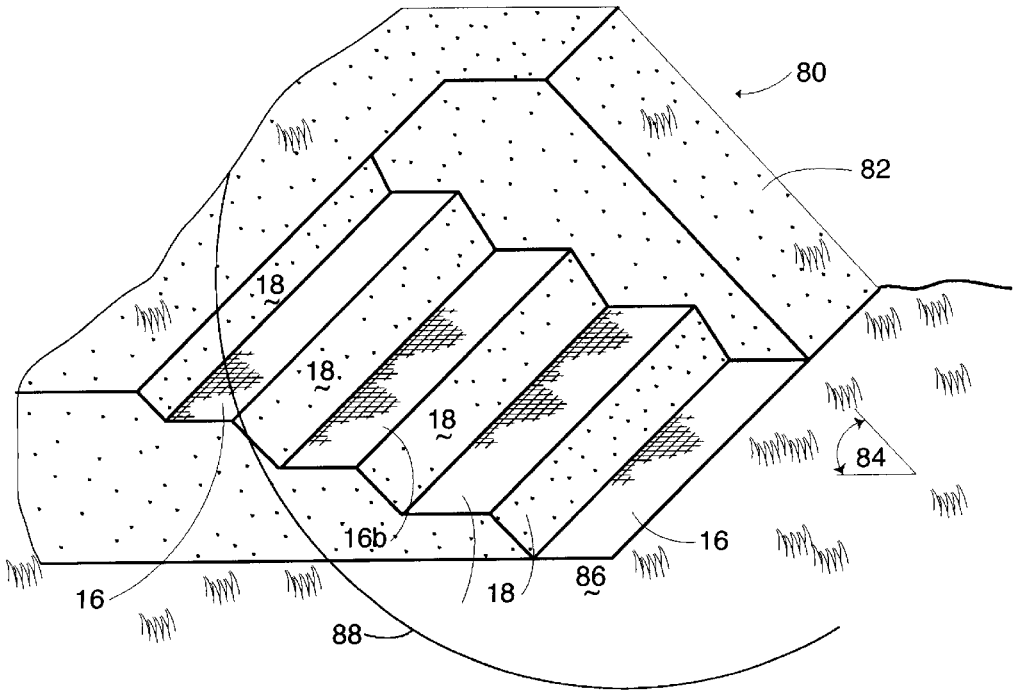
FIG. 5 is a perspective cross-sectional view of an embankment soil structure stabilized with small-aperture coated textile meshes of the present invention.

FIG. 5 is a perspective cut-away view of an embankment soil structure 80 stabilized according to the present invention. The embankment soil structure 80 has an slope face 82 having an angle 84 relative to the foundation soil 86 with a design slip circle 88. The embankment soil structure 80 is excavated of material to open a space for placement of the textile mesh 16. The excavated material preferably is used subsequently as the backfill 18 that is placed to a selected height from the foundation soil 16. A textile mesh 16*a* is placed horizontally across the backfill. Additional backfill 18 is placed over the textile mesh 16*a* including over the leading edge to re-define the slope face 82. The backfill 18 strikes through the apertures 48, and is compacted. At a next selected height of the backfill 18, a second textile mesh 16*b* is positioned substantially horizontally relative to the foundation soil 86, covered with additional backfill that is compacted to secure the strike-through material to the textile mesh. In the illustrated embodiment, four textile meshes 16 are used. The textile meshes 16 preferably extend beyond the design slip circle 88 of the slope 82 to provide sufficient anchorage of the textile meshes 16 to stabilize the embankment soil structure 80.

Figure 6:
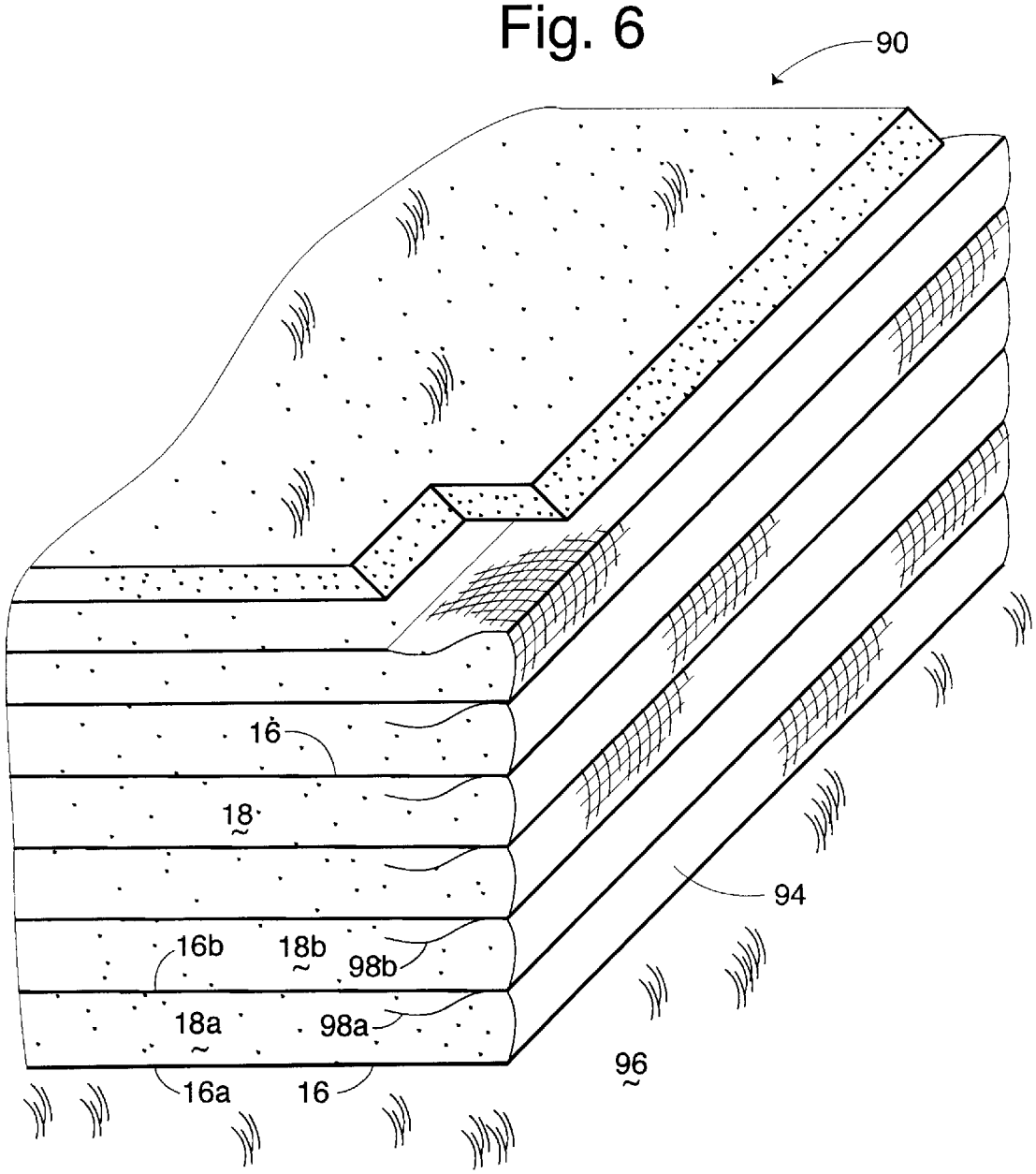
FIG. 6 is a perspective, partially cut-away view of an earthen bank stabilized with small aperture coated textile meshes of the present invention.

FIG. 6 is a perspective cross-sectional view of a steep earthen slope or embankment 90 formed of backfill 18 stabilized with a plurality of the small aperture coated textile meshes 16 of the present invention. Such a structure is typically constructed for defining walls along trails and forest areas and for building bunkers having reinforced walls. The embankment 90 defines a wall formed of a plurality of layers of textile meshes 16 and backfill 18. An initial textile sheet 16*a* is laid on the foundation soil 96 and covered with a layer of backfill 18*a*. A portion 98*a* of the textile mesh 16 extends laterally of an edge of the backfill 18*a* during placement of the backfill as the particular layer of the wall is assembled. The outwardly extended portion 98*a* of the textile mesh 16*a* is then wrapped over the exterior side 94 defined by the edge of the backfill 18*a* and rearwardly on an upper surface of the backfill. The textile sheet 16 thereby defines a first portion from which a second portion extends upwardly, with a third portion extending from the second portion in overlapping relation with at least some of the first portion. The backfill is compacted. Another textile mesh 16*b* is laid on the backfill 18*a* and the overlapping portion 98*a* of the lower textile mesh 16*a*. A portion 98*b* extends laterally of the wall 90. Backfill 18*b* is placed on the textile mesh 16b. The outwardly extended portion 98*b* of the textile mesh 16*b* is likewise wrapped over the exterior face 94*b* of the backfill and rearwardly over the backfill 18*b*. The portion 98 of each layer extends rearwardly from the face of the wall into the backfill 18 sufficiently that friction between the adjacent lower portion 98 and the upper textile sheet 16 prevents the overlapped lower portion 98 of the lower textile sheet from pulling out of the embankment. The backfill 18 is compacted. This process is continued until a retaining wall 90 is assembled to a selected height. Several angled walls can be assembled in this manner and interconnected to define a protected interior space or bunker.

The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A reinforced composite for stabilizing a soil structure such as earthen slopes and subgrades, comprising:

at least one small-aperture textile mesh for being disposed across a soil surface to be stabilized, said textile mesh comprising interwoven, knitted, or stitch-bonded longitudinal and transverse elements that define a plurality of open apertures each of a substantially uniform size as defined by respective portions of the longitudinal and transverse elements which portions each have respective first lengths and second lengths of less than 12 millimeters, said textile mesh coated with a curable material for interlocking the longitudinal and transverse elements together at junctions, whereby the textile mesh is rigidly flexible for facilitating handling during construction of a soil-stabilized earthen slope yet the junctions are substantially rigidly interlocked in order for the apertures to remain of substantially uniform size; and a plurality of backfill substantially comprising soil particles of a size having an average soil particle diameter that is less than or equal to about 30% of the smaller of said first length and said second length and at least 50% of which pass a number 4 sieve of about 4.75 mm, whereby a portion of the soil particles in the backfill strike-through the respective open apertures in the textile mesh and a portion of which mechanically engage the respective open apertures for stabilizing a soil structure.

2. The reinforced composite as recited in claim 1, wherein the tensile strength and the modulus of the longitudinal and transverse elements that bear the loading are consistent throughout the textile mesh and through the junction.

3. The reinforced composite as recited in claim 1, wherein the first length and the second length are substantially equal.

4. The reinforced composite as recited in claim 1, wherein the first length of the first portion exceeds the second length of the second portion.

5. The reinforced composite as recited in claim 1, wherein the length of the second portion exceeds the length of the first portion.

6. The reinforced composite as recited in claim 1, wherein the curable material coating the textile mesh comprises a durable solidified binder.

7. The reinforced composite as recited in claim 6, wherein the curable material comprises a liquid plastic which solidifies upon curing for locking the elements at junctions.

8. The reinforced composite as recited in claim 1, wherein the number of transverse elements per unit of length of the textile mesh is the maximum possible yet not spaced closer than the spacing for the longitudinal elements nor wider than 12 mm.

9. The reinforced composite as recited in claim 1, wherein the intersections of the longitudinal and transverse elements comprise a full leno weave.

10. A retaining wall structure for soil stabilization of earthen slopes and embankments, comprising:

a plurality of cementatious blocks stacked together to define an extended retaining wall;

at least one small-aperture textile mesh having a portion disposed between vertically adjacent blocks and extending laterally therefrom, said textile mesh comprising interwoven, knitted, or stitch-bonded weft and warp elements that define a plurality of open apertures each of a substantially uniform size as defined by a respective first and second portions of the weft and warp elements which first and second portions each have respective lengths of less than 12 millimeters, said textile mesh coated with a curable material for interlocking the weft and warp elements together at junctions, whereby the textile mesh is rigidly flexible for facilitating handling during construction of the retaining wall yet the junctions are substantially rigidly interlocked in order for the apertures to remain of substantially uniform size during use; and a plurality of backfill substantially entirely comprising particles of a size having an average diameter that is less than or equal to about 30 percent of the smaller of the lengths of said first and second portions and at least 50% of said backfill pass a number 4 sieve of 4.75 mm, whereby a portion of the particles in the backfill strike-through the respective open apertures in the textile mesh and a portion of which mechanically engage the open apertures for stabilizing soil.

11. The retaining wall as recited in claim 10, wherein the curable material coating the textile mesh comprises a durable solidified binder.

12. The retaining wall as recited in claim 11, wherein the binder comprises a liquid plastic which solidifies upon curing for locking the elements at junctions.

13. The retaining wall as recited in claim 10, wherein the tensile strength and the modulus of the warp and weft elements that bear the loading are consistent throughout the textile mesh and through the junctions.

14. The retaining wall structure as recited in claim 10, wherein the first length and the second length are substantially equal.

15. The retaining wall structure as recited in claim 10, wherein the length of the first portion exceeds the length of the second portion.

16. The retaining wall structure as recited in claim 10, wherein the length of the second portion exceeds the length of the first portion.

17. The retaining wall structure as recited in claim 10, wherein the number of weft elements per unit of length of the textile mesh is the maximum possible yet not spaced closer than the spacing for the warp elements nor wider than 12 mm.

18. The reinforced composite as recited in claim 10, wherein the intersections of the longitudinal and transverse elements comprise a full leno weave.

19. A retaining wall for soil stabilization of earthen slopes and embankments, comprising:

a plurality of layers of small-aperature textile mesh having a first portion, a second portion upstanding therefrom, and a third portion extending from the second portion laterally in spaced-apart overlapping relation with at least some of the first portion; and backfill material received on the textile mesh and at least partially enclosed by the overlapping third portion of the textile mesh, each of said textile meshes comprising interwoven, knitted, or stitch-bonded weft and warp elements that define a plurality of open apertures each of a substantially uniform size as defined by a respective first and second portions of the weft and warp elements which first and second portions each have respective lengths of less than 12 millimeters, said textile mesh coated with a curable material for interlocking the weft and warp elements together at junctions, whereby the textile mesh is rigidly flexible for facilitating handling during construction of the retaining wall yet the junctions are substantially rigidly interlocked in order for the apertures to remain of substantially uniform size during use, and the backfill material substantially entirely comprising particles of a size having an average diameter that is less than or equal to about 30 percent of the smaller of the lengths of said first and second portions and at least 50% of said backfill pass a number 4 sieve of 4.75 mm, whereby a portion of the particles in the backfill strike-through the respective open apertures in the textile meshes and a portion of which mechanically engage the open apertures for stabilizing soil in the embankment.

20. The retaining wall as recited in claim 19, wherein the curable material coating the textile mesh comprises a durable solidified binder.

21. The retaining wall as recited in claim 20, wherein the binder comprises a liquid plastic which solidifies upon curing for locking the elements at junctions.

22. The retaining wall as recited in claim 19, wherein the tensile strength and the modulus of the warp and weft elements that bear the loading are consistent throughout the textile mesh and through the junctions.

23. The retaining wall structure as recited in claim 19, wherein the first length and the second length are substantially equal.

24. The retaining wall structure as recited in claim 19 wherein the length of the first portion exceeds the length of the second portion.

25. The retaining wall structure as recited in claim 19, wherein the length of the second portion exceeds the length of the first portion.

26. The retaining wall structure as recited in claim 19 wherein the number of weft elements per unit of length of the textile mesh is the maximum possible yet not spaced closer than the spacing for the warp elements nor wider than 12 mm.

27. The reinforced composite as recited in claim 19, wherein the intersections of the longitudinal and transverse elements comprise a full leno weave.

* * * * *